US011796258B2

(12) United States Patent
Lin et al.

(10) Patent No.: US 11,796,258 B2
(45) Date of Patent: Oct. 24, 2023

(54) SEALING A HEAT PIPE

(71) Applicant: Microsoft Technology Licensing, LLC, Redmond, WA (US)

(72) Inventors: Tzu-Yuan Lin, San Francisco, CA (US); Erin Elizabeth Hurbi, San Francisco, CA (US); Dong woo Kim, Jiangsu (CN); Michael Nikkhoo, Saratoga, CA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 302 days.

(21) Appl. No.: 17/247,422

(22) Filed: Dec. 10, 2020

(65) Prior Publication Data

US 2021/0116185 A1 Apr. 22, 2021

Related U.S. Application Data

(63) Continuation of application No. 15/782,489, filed on Oct. 12, 2017, now abandoned.

(51) Int. Cl.
*F28D 15/02* (2006.01)
*F28D 15/04* (2006.01)

(52) U.S. Cl.
CPC ..... *F28D 15/0283* (2013.01); *F28D 15/046* (2013.01); *F28F 2230/00* (2013.01)

(58) Field of Classification Search
CPC .. F28D 15/0283; F28D 15/046; F28D 1/0426; F28D 7/163; F28D 2001/0266; F28F 2230/00
See application file for complete search history.

(56) References Cited

U.S. PATENT DOCUMENTS 5,443,056 A * 8/1995 Smith ..... B29C 65/18 126/263.01
6,508,302 B2 * 1/2003 Ishida ..... F28D 15/0233 165/104.21
6,725,910 B2 * 4/2004 Ishida ..... F28D 15/046 165/104.21
7,201,521 B2 * 4/2007 Zheng ..... G02B 6/4201 385/94
9,868,551 B2 * 1/2018 Smith ..... F28D 15/0275
10,793,297 B2 * 10/2020 Smith ..... B64G 1/506
2001/0047859 A1 * 12/2001 Ishida ..... B21C 37/151 165/104.21
2002/0179288 A1 * 12/2002 Ishida ..... F28D 15/046 165/104.21

(Continued)

FOREIGN PATENT DOCUMENTS

JP 10238976 * 9/1998 ..... F28D 15/0283
JP 10238976 A * 9/1998 ..... F28D 15/0283

*Primary Examiner* — Lawrence Averick
(74) *Attorney, Agent, or Firm* — Alleman Hall Creasman & Tuttle LLP

(57) ABSTRACT

Examples are disclosed that relate to sealing a heat pipe. One example provides a heat pipe including a heat pipe body having a sealed end at which opposing interior surfaces of the heat pipe body are joined, a sealant located in a least a portion of the sealed end of the heat pipe body between the opposing interior surface, the sealant having a higher oxygen transport rate than the heat pipe body, and a permanent seal forming an outer surface of the sealed end.

20 Claims, 5 Drawing Sheets

(56) References Cited

U.S. PATENT DOCUMENTS

| | | | | |
|---|---|---|---|---|
| 2005/0129373 | A1* | 6/2005 | Zheng | G02B 6/4201 385/94 |
| 2006/0000581 | A1* | 1/2006 | Chen | F28D 15/0283 165/104.21 |
| 2007/0089376 | A1* | 4/2007 | Wong | F28D 15/0283 53/50 |
| 2016/0288928 | A1* | 10/2016 | Smith | F28F 1/16 |

* cited by examiner

SEALING A HEAT PIPE

CROSS REFERENCE TO RELATED APPLICATIONS

This application is a continuation of U.S. patent application Ser. No. 15/782,489, filed Oct. 12, 2017, the entirety of which is hereby incorporated herein by reference for all purposes.

BACKGROUND

A heat pipe may be used to help cool a heat-generating component in an electronic device. A heat pipe includes a body with an interior containing a working fluid that has a liquid-solid phase transition temperature between a device operating temperature and an ambient temperature. The working fluid removes heat from an electronic component via evaporation, which results in a pressure gradient between an evaporator and a condenser of the heat pipe, causing transport of the vapor working fluid from the evaporator towards the condenser. At the condenser, heat is transferred out of the heat pipe via condensation of the working fluid, which is then returned to the evaporator of the heat pipe.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

Examples are disclosed that relate to sealing a heat pipe. One example provides a heat pipe including a heat pipe body comprising a sealed end at which opposing interior surfaces of the heat pipe body are joined, a sealant located in a least a portion of the sealed end of the heat pipe body between the opposing interior surfaces, the sealant comprising a higher oxygen transport rate than the heat pipe body, and a permanent seal forming an outer surface of the sealed end.

DETAILED DESCRIPTION

Figure 1:
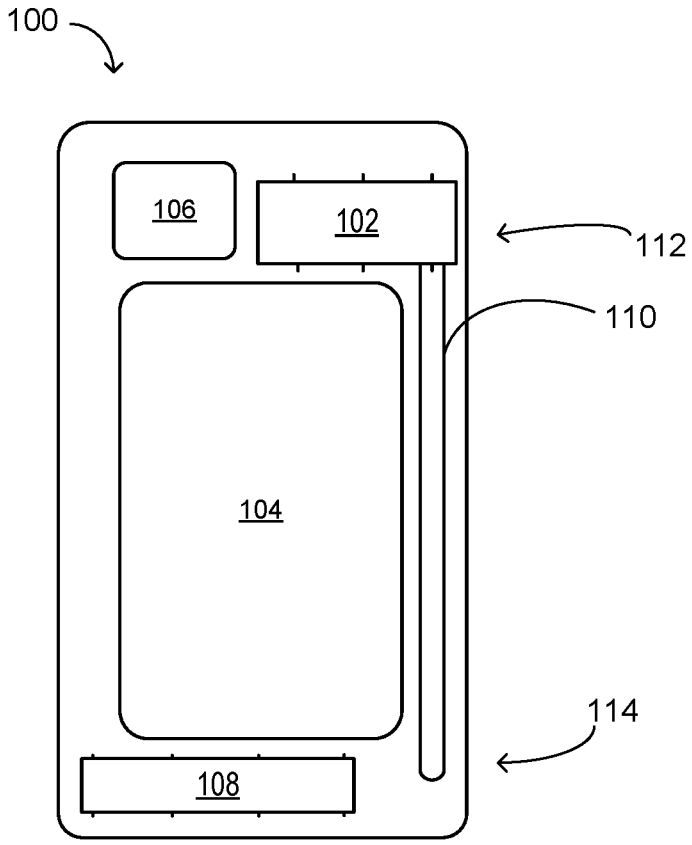
FIG. 1 schematically shows an example computing device.

Heat pipes may be incorporated into a variety of electronic devices to transport heat away from heat-generating components toward other cooling components, such as a fan and/or a heat sink. A heat pipe also may be used without other such cooling components in some devices, such as small portable devices with confined interior volumes (e.g. smart phones).

Current heat pipes may include a seal region at one end of the heat pipe that occupies space without providing any cooling benefit. Such a seal region may be referred to as a "snout," and may be present due to current heat pipe manufacturing processes. For example, to prevent an introduction of non-condensable gases (e.g. nitrogen, oxygen, and hydrogen) to an interior of the heat pipe body during manufacturing, current heat pipe manufacturing processes may include the welding of an interface tube to an open end of the heat pipe body to interface with a vacuum tube, which is used to create a vacuum inside of the heat pipe body and to introduce a working fluid into the heat pipe body. After evacuating an interior of the body and adding the working fluid to the interior, the vacuum tube may be pulled a distance away from heat pipe body while still being positioned within a portion of the interface tube. Then, the interface tube is crimped at a location between the heat pipe body and the vacuum tube in such a manner that avoids crimping the vacuum tube. This helps to maintain the desired pressure within the body and avoid introducing non-condensable gases (gases that do not condense within an intended operating temperature range of the heat pipe) into the interior of the heat pipe during sealing. However, the use of the welded interface tube, and the crimping of this tube to form a seal, also results in the formation of the snout, which occupies space and adds weight without offering any additional cooling benefit.

Accordingly, examples are disclosed that relate to heat pipes with a more compact sealing region than the snout of current heat pipes, and also to the manufacture thereof. Briefly, the disclosed examples avoid the use of an interface tube welded to an end of the heat pipe body, and use a sealant applied to an interior surface of an open end of a heat pipe body to act as a non-condensable gas barrier between an inner surface of the heat pipe body and an outer surface of a vacuum tube during manufacturing. After drawing a vacuum and adding a working fluid to the interior of the heat pipe body via a vacuum tube inserted into the open end of the heat pipe, pressure is applied to the heat pipe body to crimp together opposing interior surfaces on which the sealant is applied to form a temporary gas barrier. After forming the temporary gas barrier, the heat pipe body is cut at a location of the crimp, and a permanent gas barrier is formed (e.g. by welding or metallization) to seal the open end of the heat pipe body. The temporary gas barrier helps to prevent non-condensable gases from entering the heat pipe prior to forming the permanent seal. The permanent seal thus may be formed at different time and/or different location than the temporary gas barrier, and may be formed in a manner that avoids the snout formed by prior methods.

FIG. 1 shows a block diagram of an example computing device 100 including a heat-generating component 102. Examples of heat generating components include a system on a chip (SoC), logic components (e.g. a processor), memory components, and power supply components. Computing device 100 may represent any suitable type of computing device, such as a smart phone, tablet, laptop, or wearable device (e.g. a head-mounted display device). Computing device 100 also includes a display 104, a camera 106, and one or more other electronic components 108, such as communication subsystems, input devices, and/or sensors. It will be understood that a computing device according to the present disclosure may include any other suitable component or group of components than those shown in FIG. 1.

Computing device 100 further includes a heat pipe 110 positioned to transport heat away from the heat-generating component 102. Heat pipe 110 receives heat at an evaporator 112, either directly or via an intermediate structure such as a heat sink. This heat causes evaporation of a working fluid contained within the heat pipe 110, which forms a pressure gradient that causes the transport of working fluid vapor from the evaporator 112 towards a condenser 114. At the condenser 114, the working fluid condenses and transfers heat to a body of the heat pipe 110 and thus out of the heat pipe 110. Heat pipe 110 further may include a wick (not shown in FIG. 1) configured to return condensed working fluid to the evaporator 112 via capillary action. In other examples, the heat pipe 110 may return condensed working fluid to the evaporator 112 via gravitational force, centrifugal force, or in any other suitable manner.

Figure 2:
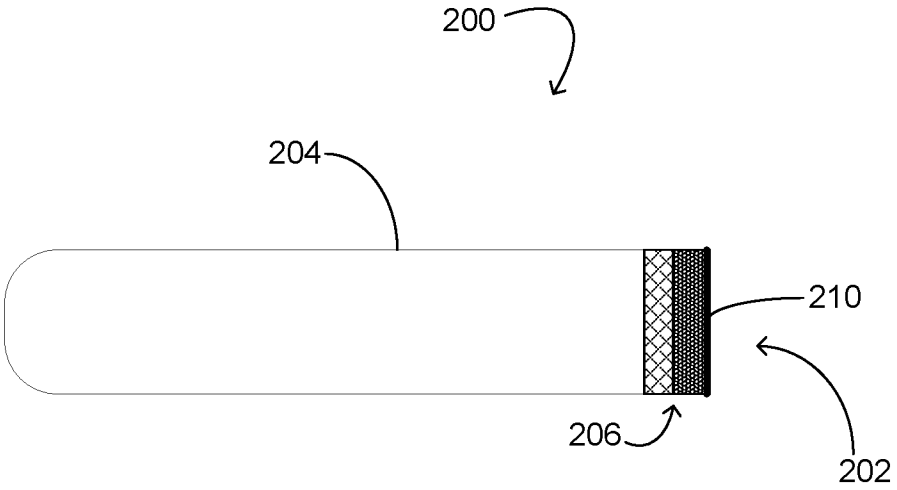
FIG. 2 schematically shows an example heat pipe.

FIG. 2 shows an example heat pipe 200 suitable for use in the computing device 100 of FIG. 1. Heat pipe 200 includes a heat pipe body 204 having a sealed end 202. Sealed end 202 includes a sealant 206 that joins interior surfaces of the heat pipe body 204 to form a temporary gas barrier during manufacturing. Heat pipe 200 also includes a permanent seal 210 forming an outer surface of the sealed end 202. Heat pipe body 204 may have any suitable shape and size, and may have other structures (e.g. a wick) not shown in FIG. 2.

Heat pipe body 204 may be formed from any suitable material, such as copper or aluminum, and may utilize any suitable working fluid. Suitable working fluids include fluids with a liquid-gas phase transition temperature within a suitable range for a desired end use, and that are chemically compatible with the material from which the heat pipe body is formed. Example working fluids include deionized water or methanol for copper heat pipes, and ammonia or acetone for aluminum heat pipes.

Sealed end 202 comprises a sealant 206 positioned between opposing interior surfaces of the heat pipe body 204 in a region where the opposing surfaces have been pressed together. In this region, the sealant 206 forms a temporary gas barrier. The term "temporary" indicates that the sealant 206 is used to seal the interior of the heat pipe body 204 after introduction of the working fluid during manufacturing, but before a permanent seal is formed. The sealant 206 may have a higher transport rate for non-condensable gases present in a manufacturing environment (e.g. various components of air) than the heat pipe body 204 or the permanent seal 210, but the transport rate may be sufficiently low to allow some time to pass between removal of the vacuum tube and the formation of the permanent seal 210. This may allow a permanent seal to be formed at a different time and/or in a different location during manufacturing than the addition of the working fluid, rather than during a same process. In some examples, the temporary gas barrier may protect the heat pipe body 204 for a period of 10-60 minutes, depending upon the sealant applied.

Sealant 206 is positioned between opposing interior surfaces of the heat pipe body 204 in an area in which the heat pipe body 204 is crimped. The sealant layers on the opposing interior surfaces come into contact when the heat pipe body 204 is crimped, and may be cured (depending on the sealant composition) by application of heat and/or suitable photon energy (e.g. x-ray energy) during crimping. In other examples, a temporary gas barrier may be formed from a non-curable sealant, such as a pressure-sensitive adhesive. The sealant 206 may be formed from any suitable material. Suitable materials may include materials having a sufficiently low non-condensable gas transport rate to prevent harmful amounts of non-condensable gases to leak into the heat pipe interior between forming the temporary and permanent seals. Examples of suitable materials may include various acrylics, epoxies, polyurethanes, thermoplastics, and pressure-sensitive adhesives.

Further, the sealant 206 may be applied in any suitable form. In some examples, the sealant 206 may be applied as a fluid (e.g. by painting the sealant onto an interior surface of the heat pipe body). In other examples, the sealant 206 may be applied in a non-fluid form, such as a laminated film. One example of a multilayer laminated material may include a polyepoxy/polyamine resin applied on a substrate. Examples of such materials include those sold under the trade name MAXIVE, available from Mitsubishi Gas Chemical Company, Inc. of Tokyo, Japan. Suitable MAXIVE films include those having an oxygen transfer rate at or below 0.06

$$\frac{\text{cc} - \text{mm}}{\text{m}^2 - 24\ \text{hr} - \text{atm}}$$

in operating conditions of 23° C. between 60-90% relative humidity. When applied to an interior of a heat pipe, crimping of the sealant 206 combined with the application of heat may cure the MAXIVE sealant, thereby forming the temporary gas barrier. A multilayer laminate material also may include an adhesive layer, such as a thermoplastic adhesive, a pressure-sensitive adhesive, and/or any other suitable material for joining to an interior surface of the heat pipe body 204. In yet other examples, a composite material may be used as a sealant (e.g. a metal-containing composite layer or other composite layer).

Permanent seal 210 forms an outer surface of the sealed end 202, and is configured to have a lower transport rate(s) of non-condensable gas(es) than the sealant 206 of the temporary gas barrier. In some examples, the permanent seal 210 may comprise a weld. In other examples, the permanent seal 210 may comprise a metallization film layer, a solder layer, or other metal layer. As mentioned above, the permanent seal 210 may be formed at a different time and/or location than the temporary gas barrier, which may simplify manufacturing.

Figure 3:
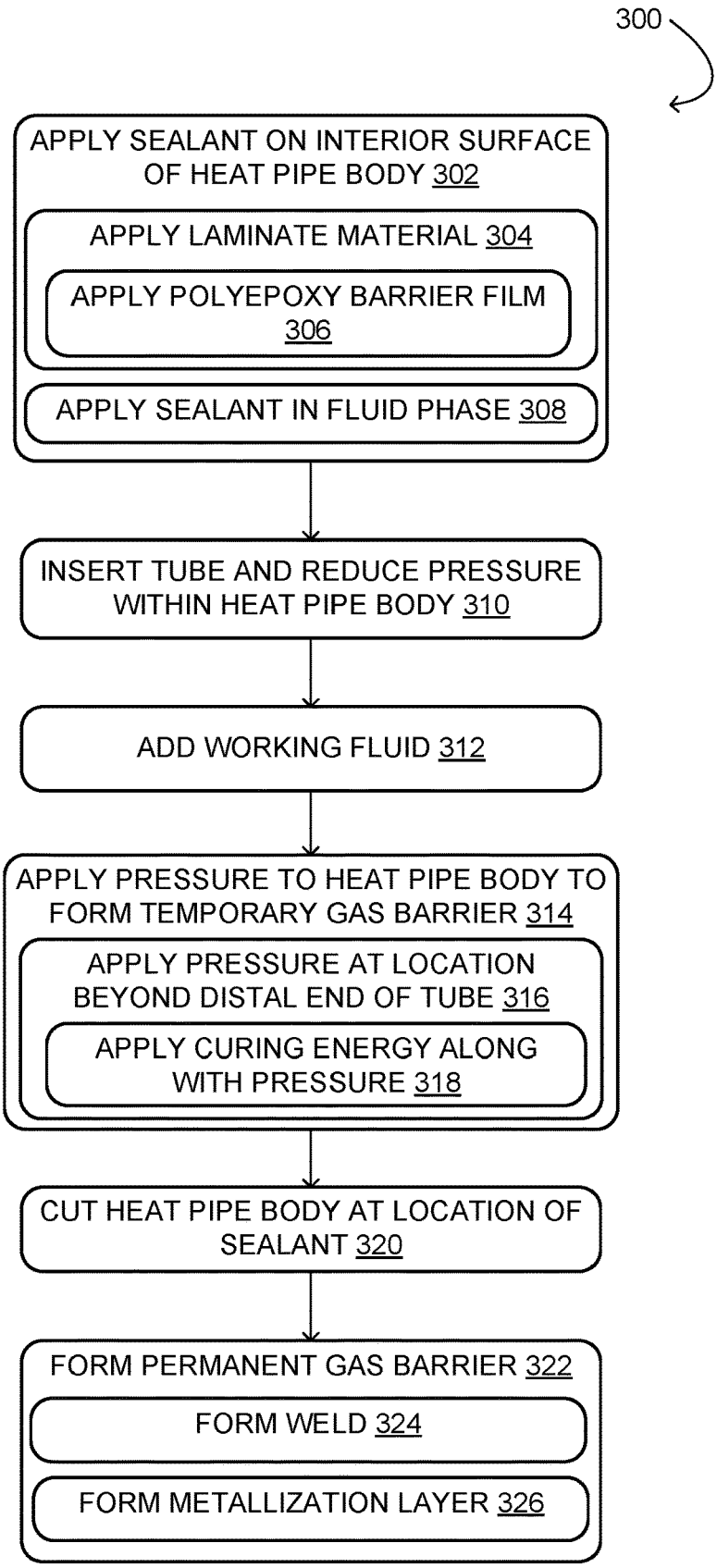
FIG. 3 shows a flowchart of an example method for manufacturing a heat pipe.

FIG. 3 depicts an example method 300 for manufacturing a heat pipe, such as heat pipe 200. In some examples, any or all processes of method 300 may occur in a reduced-oxygen or reduced-air environment to prevent exposure of non-condensable gases to an interior of the heat pipe body during manufacturing. In other examples, any or all processes of method 300 may be performed in an ambient environment.

Figure 4:
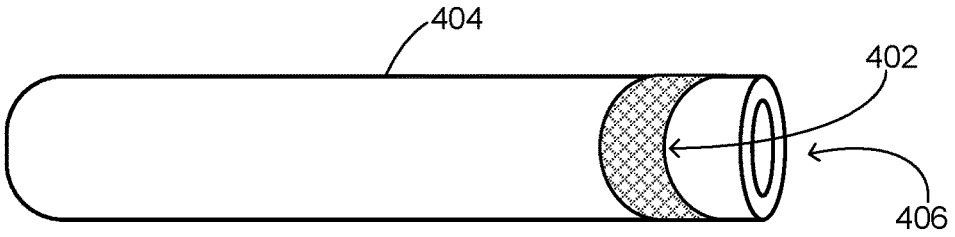
FIG. 4 illustrates an example heat pipe body after applying a sealant to an interior surface of the heat pipe.

At 302, method 300 comprises applying a sealant on an interior surface of a heat pipe body. As shown by example in FIG. 4, a sealant 402 is applied on an interior surface of an example heat pipe body 404 adjacent to an open end 406 of the heat pipe body 404. Sealant 402 may be applied in any suitable quantity and in any suitable location to achieve desired gas barrier properties and to form a seal between opposing interior surfaces of the heat pipe body 404. For example, as shown at 304, the sealant may be applied as a laminate material comprising two or more functional layers. In some examples, the multilayer laminate material may be applied as a tape, where a substrate adheres to an interior surface of the heat pipe body and one or more additional layers provide gas barrier and adhesion properties to join opposing interior surfaces of the heat pipe body and form a temporary gas barrier. Any suitable laminate may be used, including but not limited to laminates comprising a polyepoxy barrier film, as indicated at 306. As a more specific example, the multilayer laminate film may include polyepoxy/polyamine resin materials sold under the name MAXIVE, available from Mitsubishi Gas Chemical Co. of Tokyo, Japan.

In yet other examples, as indicated at 308, the sealant may be applied as a fluid phase, such as via a painting or printing process. As a more specific example, a two-part epoxy or other suitable fluid phase sealant may be applied on an interior surface of the heat pipe body. Further, in some examples, both a fluid phase material and a multilayer laminate material may be applied on the interior surface of the heat pipe body. In yet other examples, any other suitable sealant may be used.

Figure 5:
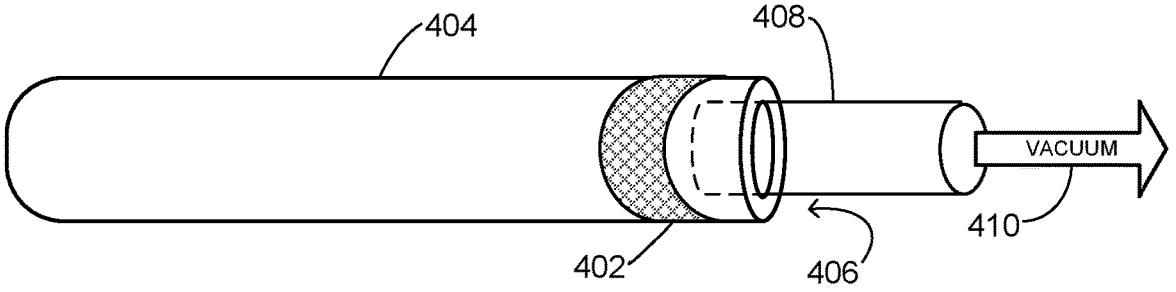
FIG. 5 schematically shows a tube inserted the example heat pipe body of FIG. 4 for adding a working fluid to an interior the heat pipe body.
Figure 6:
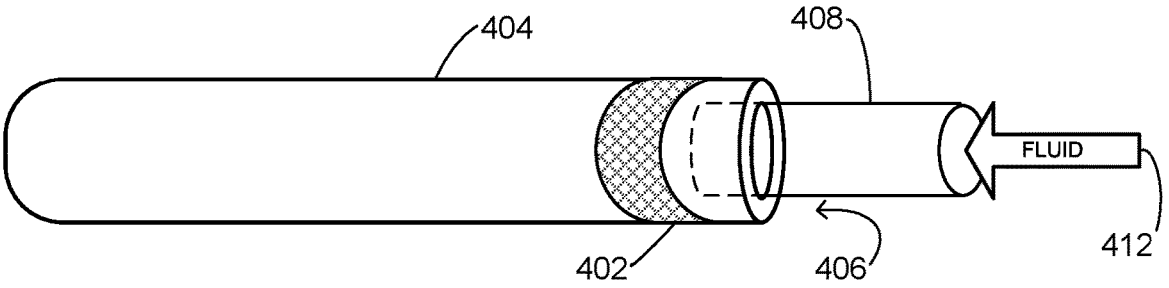
FIG. 6 schematically shows the addition of a working fluid to an interior of the example heat pipe body of FIG. 4.

At 310, method 300 includes inserting a tube in the open end of the heat pipe body and reducing a pressure within the heat pipe body by drawing a vacuum 410 via the tube. In this process, schematically shown in FIG. 5, an exterior surface of the tube 408 maintains contact with an interior surface of the heat pipe body 404 to form a seal for drawing the vacuum, and may contact the sealant 402. Further, at 312, method 300 includes adding a working fluid via the tube to an interior of the heat pipe body. FIG. 6 schematically shows the addition of a working fluid 412 via the tube 408. Any suitable working fluid may be added, including the examples described above.

Figure 7:
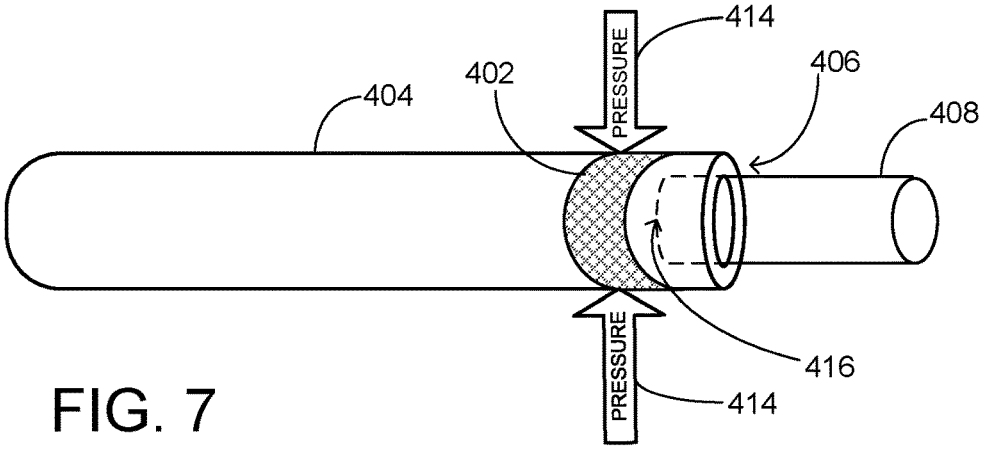
FIG. 7 schematically shows the application of mechanical pressure to the example heat pipe body of FIG. 4 to form a temporary gas barrier via the sealant.
Figure 8:
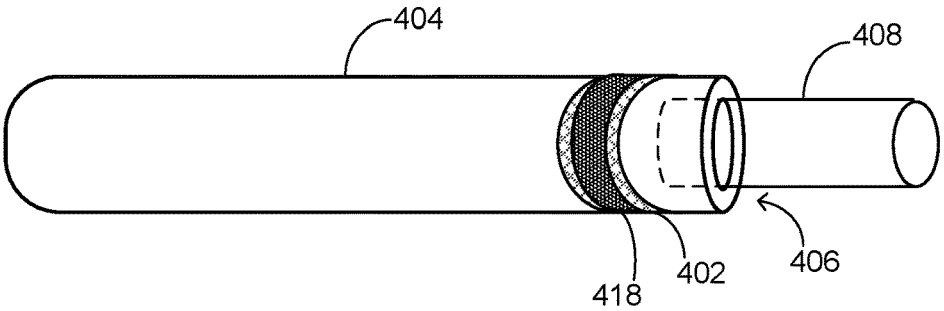
FIG. 8 schematically shows the example heat pipe body of FIG. 4 after forming the temporary gas barrier.

Method 300 further comprises, at 314, applying pressure to the heat pipe body while the tube is still located within the heat pipe body to press together opposing interior surfaces on which the sealant is applied to form a temporary gas barrier. As an example, applying pressure may comprise deforming one or more sides of the heat pipe body via a crimping tool to join opposing interior surfaces. In such an example, the crimping tool may comprise a linear crimp, a half-moon crimp, or any other suitable type of crimp. FIG. 7 schematically depicts method 300 at 316, where method 300 may comprise, in some examples, applying pressure 414 at a location beyond a distal end 416 of the tube 408 inserted in the open end 406. Further, as indicated at 318, curing energy (e.g. heat or a suitable photonic energy, such as x-ray radiation) may be applied to cure the temporary gas barrier where the temporary gas barrier comprises a curable polymer. FIG. 8 depicts a temporary gas barrier 418 formed between opposing interior surfaces of the heat pipe body 404 on which the sealant 402 is applied. As shown, the tube 408 is omitted from the seal between opposing interior surfaces of the heat pipe body 404.

Figure 9:
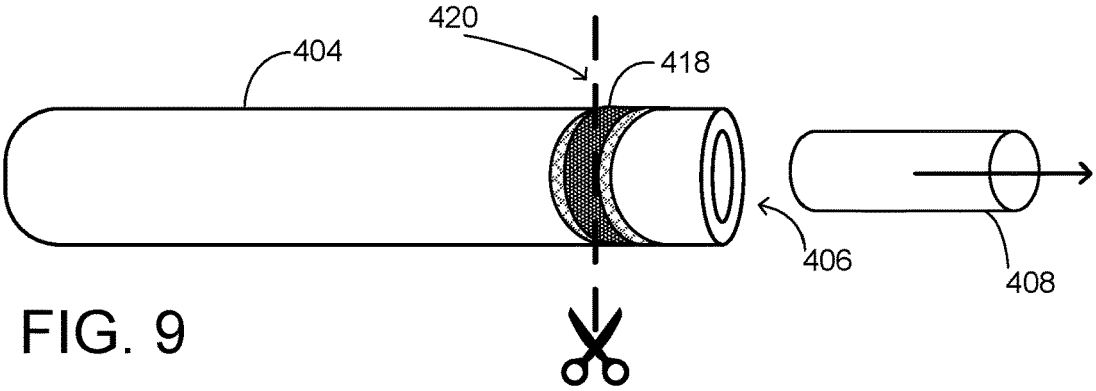
FIG. 9 schematically shows the cutting of the example heat pipe body of FIG. 4.
Figure 10:
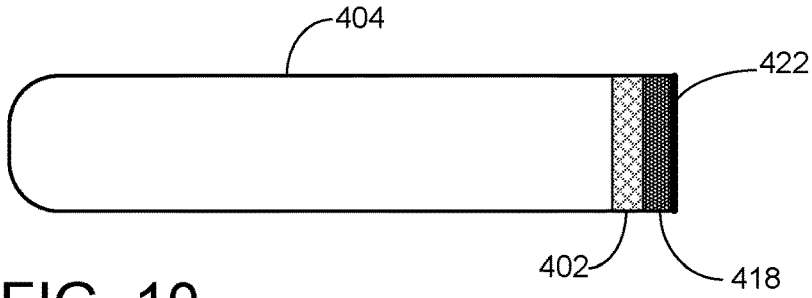
FIG. 10 illustrates the example heat pipe body of FIG. 4 after formation of a permanent seal.

After forming the temporary gas barrier, method 300 includes, at 320, cutting the heat pipe body at a location of the sealant. FIG. 9 shows an example location (indicated by dashed line 420) of the sealant 402 where the heat pipe body 404 may be cut after forming the temporary gas barrier 418. Tube 408 may be removed from the open end 406 of the heat pipe body 404 after forming the temporary gas barrier or after cutting the heat pipe body 404. This may help to avoid the formation of a snout region at the end of the heat pipe, and thus reduce a physical length of the device without reducing a functional length compared to a similar heat pipe manufactured with a snout. In the example of FIG. 9, the heat pipe body 404 is cut within the region of the temporary gas barrier 418, but in other examples, the heat pipe body 404 may be cut at a location between the temporary gas barrier 418 and the open end 406.

Continuing with FIG. 3, method 300 comprises, at 322, forming a permanent seal 422 after forming the temporary gas barrier 418 and cutting the heat pipe body 404. Permanent seal 422 may be formed in any manner that forms a barrier with a suitably lower non-condensable gas transport rate (or rates) compared to the temporary gas barrier. For example, welding may be used to form a welded seal as indicated at 324 of FIG. 3, or metallization (e.g. electroless plating, electroplating, or physical vapor deposition) may be used to form the permanent seal 422 as indicated at 326 of FIG. 3.

Another example provides a heat pipe comprising a heat pipe body comprising a sealed end at which opposing interior surfaces of the heat pipe body are joined, a sealant located in a least a portion of the sealed end of the heat pipe body between the opposing interior surfaces, the sealant comprising a higher oxygen transport rate than the heat pipe body, and a permanent seal forming an outer surface of the sealed end. In such examples, the sealant may additionally or alternatively comprise a polymer material. In such examples, the sealant may additionally or alternatively comprise an epoxy material. In such examples, the epoxy material may additionally or alternatively comprise a polyepoxy/polyamine material. In such examples, the sealant may additionally or alternatively comprise a laminated film. In such examples, the sealant may additionally or alternatively comprise one or more of a thermoplastic material and a pressure sensitive adhesive. In such examples, the permanent seal may additionally or alternatively comprise a weld. In such examples, the permanent seal may additionally or alternatively comprise a metallization layer.

Another example provides a method for manufacturing a heat pipe, the method comprising applying a sealant on an interior surface of a heat pipe body adjacent to an open end of the heat pipe body, inserting a tube in the open end of the heat pipe body and reducing a pressure within the heat pipe body via the tube, adding a working fluid to the interior of the heat pipe body, while the tube is inserted in the open end of the heat pipe body, applying pressure to the heat pipe body to press together opposing interior surfaces on which the sealant is applied to form a temporary gas barrier, and after forming the temporary gas barrier, forming a permanent gas barrier to seal the open end of the heat pipe body. In such examples, applying the sealant may additionally or alternatively comprise applying a multilayer laminate material. In such examples, applying the sealant may additionally or alternatively comprise applying a polyepoxy barrier film. In such examples, applying the sealant may additionally or alternatively comprise applying the sealant in a fluid phase. In such examples, applying pressure to the heat pipe body may additionally or alternatively comprise applying pressure at a location beyond a distal end of the tube inserted in the open end. In such examples, applying pressure to the heat pipe body may additionally or alternatively comprise applying heat at the location beyond the distal end of the tube to form a seal with the sealant. In such examples, forming the permanent gas barrier may additionally or alternatively comprise one or more of forming a weld and forming a metallization layer. In such examples, the method may additionally or alternatively comprise cutting the heat pipe body at a location of the sealant after forming the temporary gas barrier.

Another example provides an electronic device comprising a heat-generating component, and a heat-pipe positioned to transport heat from the heat-generating component, the heat pipe comprising a heat pipe body comprising a sealed end at which opposing interior surfaces of the heat pipe body are joined, a sealant located in a least a portion of the sealed end of the heat pipe body between the opposing interior surface, the sealant comprising a higher oxygen transport rate than the heat pipe body, and a permanent seal forming an outer surface of the sealed end, the permanent seal comprising a lower oxygen transport rate than the sealant. In such examples, the electronic device may additionally or alternatively comprise a portable electronic device. In such examples, the sealant may additionally or alternatively comprise one or more of an epoxy polymer and a thermoplastic adhesive. In such examples, the permanent seal may additionally or alternatively comprise one or more of a weld and a metallization layer.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and non-obvious combinations and sub-combinations of the various processes, systems and configurations, and other features, functions, acts, and/or properties disclosed herein, as well as any and all equivalents thereof.

The invention claimed is:

1. A method for manufacturing a heat pipe, the method comprising:

applying a sealant on an interior surface of a heat pipe body adjacent to an open end of the heat pipe body, the sealant comprising a material having a higher oxygen transport rate than the heat pipe body;

inserting a tube in the open end of the heat pipe body and reducing a pressure within the heat pipe body via the tube;

adding a working fluid to an interior of the heat pipe body;

while the tube is inserted in the open end of the heat pipe body, applying pressure to the heat pipe body to press together opposing interior surfaces on which the sealant is applied to form a temporary gas barrier; and after forming the temporary gas barrier, forming a permanent gas barrier to seal the open end of the heat pipe body.

2. The method of claim 1, wherein applying the sealant comprises applying a multilayer laminate material.

3. The method of claim 1, wherein applying the sealant comprises applying a polyepoxy barrier film.

4. The method of claim 1, wherein applying the sealant comprises applying the sealant in a fluid phase.

5. The method of claim 1, wherein applying pressure to the heat pipe body comprises applying pressure at a location beyond a distal end of the tube inserted in the open end to form a seal with the sealant.

6. The method of claim 1, wherein forming the permanent gas barrier comprises one or more of forming a weld and forming a metallization layer.

7. The method of claim 1, further comprising cutting the heat pipe body at a location of the sealant after forming the temporary gas barrier.

8. The method of claim 7, wherein cutting the heat pipe body comprises cutting the heat pipe body through the sealant.

9. The method of claim 1, wherein applying the material comprises applying a film having an oxygen transfer rate of or less than 0.06 (cc-mm)/(m2-24 hr-atm).

10. The method of claim 1, wherein applying the sealant comprises applying a pressure-sensitive adhesive.

11. The method of claim 1, wherein applying the sealant comprises applying a curable material, the method further comprising applying curing energy to form the temporary gas barrier.

12. The method of claim 11, wherein applying the curing energy comprises applying heat or photonic energy.

13. The method of claim 1, wherein applying the sealant comprises applying one or more of a thermoplastic adhesive or a composite material.

14. A method for manufacturing a heat pipe, the method comprising:

applying a sealant comprising a material having a higher oxygen transport rate than a heat pipe body on an interior surface of the heat pipe body adjacent to an open end of the heat pipe body;

inserting a tube in the open end of the heat pipe body and reducing a pressure within the heat pipe body via the tube;

adding a working fluid to an interior of the heat pipe body;

while the tube is inserted in the open end of the heat pipe body, applying pressure to the heat pipe body to press together opposing interior surfaces on which the sealant is applied to form a temporary gas barrier; and after forming the temporary gas barrier, forming a permanent gas barrier from a different material than the sealant to seal the open end of the heat pipe body.

15. The method of claim 14, wherein forming the permanent gas barrier comprises one or more of forming a weld and forming a metallization layer.

16. The method of claim 14, further comprising cutting the heat pipe body at a location of the sealant after forming the temporary gas barrier.

17. The method of claim 16, wherein cutting the heat pipe body comprises cutting the heat pipe body through the sealant.

18. A method for manufacturing a heat pipe, the method comprising:

applying a sealant on an interior surface of a heat pipe body adjacent to an open end of the heat pipe body, the sealant comprising a material having a higher oxygen transport rate than the heat pipe body;

inserting a tube in the open end of the heat pipe body and reducing a pressure within the heat pipe body via the tube;

adding a working fluid to an interior of the heat pipe body;

while the tube is inserted in the open end of the heat pipe body, applying pressure to the heat pipe body to press together opposing interior surfaces on which the sealant is applied to form a temporary gas barrier;

after forming the temporary gas barrier, cutting the heat pipe body at a location of the sealant, and after cutting the heat pipe body, forming a permanent gas barrier to seal the open end of the heat pipe body.

19. The method of claim 18, wherein forming the permanent gas barrier comprises one or more of forming a weld and forming a metallization layer.

20. The method of claim 18, wherein cutting the heat pipe body comprises cutting the heat pipe body through the sealant.

* * * * *